United States Patent [19]

Kibby

[11] 4,204,860

[45] May 27, 1980

[54] MAGNESIUM PRODUCTION

[75] Inventor: Robert M. Kibby, Richmond, Va.

[73] Assignee: Reynolds Metals Company, Richmond, Va.

[21] Appl. No.: 944,493

[22] Filed: Sep. 20, 1978

[51] Int. Cl.[2] ..... C22B 45/00

[52] U.S. Cl. ..... 75/10 R; 75/67 R

[58] Field of Search ..... 75/67 R, 67 A, 10 R, 75/10 A

[56] References Cited

U.S. PATENT DOCUMENTS

| | | | |
|---|---|---|---|
| 3,579,326 | 5/1971 | Avery | 75/67 R |
| 3,782,922 | 1/1974 | Avery | 75/67 R |

*Primary Examiner*—M. J. Andrews

*Attorney, Agent, or Firm*—Glenn, Lyne, Girard, Clark and McDonald

[57] ABSTRACT

Magnesium metal is produced in a magnesium reduction furnace by the reaction of aluminum metal with a calcium magnesium aluminate slag or with magnesium oxide in the presence of such slag, wherein aluminum is fed to the magnesium reduction furnace as an aluminum silicon alloy and wherein magnesium oxide is fed in less than stoichiometric amounts so that not all of the aluminum is reduced, such additions producing magnesium vapor and two liquid layers: an aluminum silicon alloy having a reduced aluminum content and a $MgO.CaO.Al_2O_3.TiO_2$ slag. The aluminum silicon alloy layer is tapped and recovered from the furnace. The recovered alloy may be used in the production of silicon alloy product by addition to aluminum.

15 Claims, 2 Drawing Figures

MAGNESIUM PRODUCTION

BACKGROUND OF THE INVENTION

This invention relates to the metallothermic preparation of metals and more particularly is concerned with a novel process for the production of magnesium metal by the metallothermic reduction of magnesium oxide at high temperatures in the presence of an aluminum silicon alloy reducing agent and a molten oxidic slag in an electric furnace and the condensation and recovery of vaporized magnesium in a condenser.

Thermal reduction processes for the conversion of magnesium oxide or of substances containing magnesium oxide to metallic magnesium have evolved along two general lines: those which use carbon as a reducing agent (i.e., carbothermic processes) and those which use free metals as a reducing agent (i.e., metallothermic processes). In both types of processes the necessary heat of reaction is usually supplied by an electric arc furnace in which an electric current may be passed through the feedstock mixture and usually is passed through the resulting liquid or solid slag by-product. It is known that aluminum is a very effective free-metal reducing agent for magnesium oxide. It is also known that aluminum can be obtained relatively cheaply in the form of an aluminum silicon alloy, for example, by carbothermic smelting of aluminum-silicate ores. Examples of known processes for the production of magnesium wherein an aluminum-silicon alloy is used as the metallic reducing agent are described below.

U.S. Pat. No. 3,579,326 teaches a process for producing magnesium by reducing magnesium oxide from an oxidant containing a major proportion of magnesia (rather than dolomitic lime) with a metallic aluminum-silicon alloy reductant having a ratio of silicon to aluminum of at least 0.8 to 1.0 (i.e., of at least about 40 percent Si) at a temperature of at least 1400° C. and at a pressure of about 1 atmosphere in the presence of a molten slag containing 15 to 35 percent alumina, less than 30 percent calcium oxide, 5 to 25 percent magnesium oxide, and 25 to 50 percent silica. The molecular ratio of magnesium oxide to calcium oxide in the oxidant of the U.S. Pat. No. 3,579,326 process is at least 2:1. The ratio of aluminum and magnesium oxides to silicon dioxide in the slag is less than 1.6, the aluminum and magnesium oxides comprise less than 50 percent of the slag, and the ratio of calcium oxides to the silicon dioxide of the slag is less than 1.6. Generally the patent teaches that:

> The composition of slag is determined by the ratio of aluminum to silicon fed as the reducing agent, the degree of utilization of silicon as reductant, *which for reasons of economy should be as high as feasible;* and the relative proportion of magnesium oxide fed as magnesia and as dolomitic lime. (Column 4, lines 38–43) (emphasis added)

The examples summarized in Table I of said patent show production of a ferrosilicon alloy by-product containing from 56 to 75 percent Si when the metallic aluminum silicon alloy reductant also contains iron, but show no production by-product alloy when iron is not present in the reductant.

U.S. Pat. No. 3,782,922 teaches a process for producing magnesium by reducing magnesium oxide from an oxidant containing a major proportion of magnesium oxide (the weight ratio of MgO:CaO in the oxidant is between about 1.1 and 2.3) with a substantially pure aluminum reductant (i.e., the reductant contains at least 85 percent aluminum) at a temperature between about 1300° C. and 1700° C. and at a pressure of about 1 atmosphere wherein the slag produced as a by-product of the reaction has a composition of about 35–65 percent alumina, 35–55 percent calcium oxide, 0–10 percent silica, and less than 5 percent magnesia (when the slag is removed from the system). The particular calcium aluminate slag produced by this process is said to be highly advantageous in that alumina can readily be recovered by leaching the slag with $Na_2CO_3$ solution. Among the asserted advantages of the U.S. Pat. No. 3,782,922 process is the virtually complete consumption of the aluminum reducing agent in the primary reaction, which avoids the necessity of recycling or disposing of considerable quantities of spent metal (Column 4, lines 69–74). However it is noted at the bottom of Table III appearing in Column 11 of the specification that "The magnesium produced will contain up to 20 percent Al." Compare the following statements appearing at Column 3, lines 24–45 of the same specification:

> Finally, there is the question of aluminum itself as an impurity in the magnesium product, since aluminum has, a vapor pressure of about 10 mm. Hg at 1500° C. This means that magnesium produced by the present process will inevitably contain aluminum—how much depends upon the operating temperature. At 1400° C., for example, it would contain about 0.5 percent, at 1500° C. about 1.2 percent and at 1600° C., about 2 percent of aluminum. However, this is not a serious problem and may in fact be beneficial, because: (a) the principal use for magnesium today is to produce aluminum alloys for fabrication; and (b) a major portion of the magnesium used for fabricated magnesium products contains a substantial proportion of aluminum—generally from 3 to 9 percent. Thus the presence of a small amount of aluminum in the magnesium produced by the present process is not detrimental, especially if the magnesium operation is associated with the production of aluminum, which is likely to be the case because of the advantage of recovering $Al_2O_3$ from the slag produced, and the possibility of using captive scrap as the reducing agent.

Whatever the specific aluminum content of the magnesium produced by the U.S. Pat. No. 3,782,922 process may be, it is clear that the product will contain a significant amount of aluminum. Furthermore, since nearly all of the magnesium oxide present in the oxidant charge is converted to metallic magnesium vapor in the reduction furnace (the magnesia content of the slag is less than 5 percent, preferably less than 2 percent), it is apparent that, according to the U.S. Pat. No. 3,782,922 teaching, the quantity of aluminum reductant fed to the furnace may be somewhat greater than the stoichiometric amount. This is expected because of relatively high vapor pressure of aluminum metal at the process temperature and the consequent carry-over of aluminum vapor with the volatile magnesium product. Nevertheless, the U.S. Pat. No. 3,782,922 process does not produce a by-product spent alloy reductant (as noted above). FIG. 1 of the patent does show removal of a "metallic residue" from the furnace, but that "residue" refers to "impurities" such as copper or chromium which are present in certain alloys and scraps which may be employed as the "substantially pure aluminum" reductant in the process (see Column 8, lines 43–56).

U.S. Pat. No. 4,033,758 teaches a process for producing magnesium by reducing magnesium in a calcium magnesium aluminum silicate slag or magnesium oxide in the presence of such a slag with a metallic aluminum silicon alloy reductant comprising from 15 to 75 percent by weight aluminum and from 20 to 80 percent by weight silicon at a temperature of about 1400° to 1650° C. and a pressure of about 25 to 500 mm of Hg (about 0.03 to 0.66 atmosphere) in the presence of a molten slag containing 11 to 38 percent alumina, 42 to 65 percent calcium oxide, 1 to 11 percent magnesium oxide, and 5 to 19 percent silica. The amount of magnesium oxide fed to the reaction zone is at least 101 percent of the amount theoretically required to react with the aluminum silicon alloy reductant.

U.S. Pat. No. 4,033,759 teaches a process for producing magnesium by reducing magnesium in a calcium magnesium aluminum silicate slag or magnesium oxide in the presence of such a slag with metallic aluminum reductant containing at least 80 weight percent aluminum at a temperature of about 1350° to 1700° C. and a pressure of about 0.5 to 2.0 atmospheres in the presence of a molten slag containing 28 to 64 percent alumina, 30 to 65 percent calcium oxide, 6 to 13 percent magnesium oxide, and less than 5 percent silica. The amount of magnesium oxide fed to the reaction zone is at least 110 percent of the amount theoretically required to react with the aluminum metal reductant. The patent suggests that it is essential to keep the silica concentration in the furnace at a low value (less than 5 weight percent) when using aluminum metal as a reducing agent because of the undesirable side reaction of aluminum with silica to produce by-product silicon metal (Column 3, lines 42 to 63). The combination of reactants taught by the U.S. Pat. No. 4,033,759, particularly the high concentration of aluminum metal in the reductant and the stoichiometric excess of magnesium oxide, is said to provide a superior process in that the reaction between aluminum metal and magnesium readily occurs and a high utilization of expensive aluminum metal is obtained.

U.S. Pat. No. 3,441,402 claims a metallothermic method for the production of magnesium in a submerged arc furnace wherein an oxidant mixture of calcined dolomite and a second magnesium ore selected from the group consisting of calcined magnesite and dried serpentine is reduced with a reducing agent at temperatures below about 1500°C. and pressures of about 1 atmosphere. The patent teaches the use of aluminum-silicon alloys containing from about 30 to 100 weight percent aluminum as a reducing agent in the process (Column 3, lines 32–35). The Examples suggest the addition of aluminum-silicon alloy in approximately stoichiometric amounts: the operations of Example 1 show a slight (6–13%) excess of silicon-aluminum alloy (which alloy contains 66.34 weight percent aluminum) and Example 2 also suggests an excess of silicon-aluminum alloy. The Examples further suggest that the reduction of the mixture of magnesium ores occurs in the presence of a molten slag containing about 20 to 30 percent alumina, 30 to 50 percent calcium oxide, less than 10 percent magnesium oxide, and 15 to 40 percent silica.

Of the five foregoing patents describing metallothermic processes for the conversion of magnesium oxide or of substances containing magnesium oxide to metallic magnesium using an aluminum-silicon alloy as reductant, three of the patents teach or suggest the addition of less than the stoichiometric amount of magnesium oxide theoretically required to react with the metallic reductant: U.S. Pat. Nos. 3,579,326; 3,782,922; and 3,441,402. However, none of these three patents teach or suggest the addition of less than the stoichiometric amount of magnesium oxide theoretically required to react with the aluminum component of an aluminum-silicon alloy reductant—with the possible exception of U.S. Pat. No. 3,782,922 (which, it should be noted, employs a "substantially pure aluminum reductant"). The excess addition of reductant in the U.S. Pat. No. 3,782,922 process is necessary to compensate for reduction losses caused by the relatively high vapor pressure of the reductant at process temperatures. Accordingly, none of the patents specifically teach or suggest the addition of less than the stoichiometric amount of magnesium oxide theoretically required to react with the aluminum component of an aluminum-silicon alloy reductant present in a magnesium reduction zone. Furthermore, none of the patents specifically teach or suggest the addition of less than the stoichiometric amount of magnesium oxide theoretically required to react with aluminum combined with the retention of unreacted aluminum in the by-product alloy; none of the patents teach or suggest the addition of sufficiently less than stoichiometric amounts of magnesium oxide so as to have aluminum remaining in a by-product alloy.

It may be noted, though, that U.S. Pat. No. 2,847,295 does teach the addition of a surplus of metallic reductant—an amount exceeding the theoretically necessary amount to completely reduce magnesium oxide contained in an oxidant feed—and more particularly teaches that when the reductant component acting as the reduction material is added with accompanying metals, the surplus of the reductant component should be such that compounds or alloys of the component with the accompanying metals will remain after the reaction is completed. The object of the surplus addition is to minimize the deleterious effect of the compounds or alloys on the reaction capability of the reductant component acting as the reduction material and to maintain an "almost metallic conductivity"in shaped bodies comprising the reaction medium until the end of the reaction. Unlike the hereinbefore described process, the U.S. Pat. No. 2,847,295 process does not reduce magnesium oxide in the presence of a molten oxidic slag. Rather, the reactant and residual materials are maintained in the solid state without the appearance of a liquid phase (see Column 2, lines 11–15 and Column 4, lines 7–23).

Another process of interest (although it does not teach the use of an aluminum silicon alloy reductant) is disclosed in British Pat. No. 922,300 which is a modified aluminothermic process called the "MC process". The process described therein is a two-stage cyclic process for the production of magnesium. In the first stage, a material containing magnesium oxide and lime is reduced by means of aluminum to form magnesium metal vapor and a calcium aluminate slag. In the second stage, the calcium aluminate slag is reacted with carbon in the presence of an auxilliary metal selected from the group consisting of iron and copper to form calcium carbide, a residual slag, and an alloy of aluminum metal with the auxilliary metal, which alloy is returned to the first stage for the production of further quantities of magnesium metal. The auxilliary metal thus serves as a carrier metal for the aluminum metal reductant. Like the teachings previously discussed, this patent neither shows nor suggests the addition of less than the stoichiometric amount of magnesium oxide theoretically required to react with the aluminum component of an aluminum alloy reductant; the Example shows the addition of an excess of about 14 percent magnesium oxide.

SUMMARY OF THE INVENTION

Generally, the present invention may be characterized as a metallothermic or modified aluminothermic process for the production of magnesium operable at atmospheric pressure wherein an aluminum silicon alloy reductant and a magnesium oxide oxidant charged principally as dolomite in an amount corresponding to less that the stoichiometric amount of magnesium oxide theoretically required to consume the aluminum component of the aluminum-silicon alloy reductant are reacted in a magnesium reduction furnace containing two liquid layers—an aluminum-silicon alloy of increased silicon content (relative to the reductant charged) and a molten calcium magnesium aluminate slag, evolving magnesium vapor from the reaction zone, condensing and recovering the magnesium as a product, tapping the aluminum-silicon alloy of increased silicon content from the reaction zone as a by-product, and rejecting the calcium magnesium aluminate slag from the system. The alloy by-product may be used to produce a silicon alloy product by addition to aluminum.

Because of the addition of less than stoichiometric amounts of magnesium oxide theoretically required to react with the aluminum component of the alloy reductant, two immiscible liquid phases are present in the reduction furnace—a lower layer comprising slag and an upper layer of alloy. By controlling the ratio of Al:Si in the alloy reductant, the charge rate of the alloy reductant, the charge rate of the oxidant, and the weight ratio of MgO to aluminum in the charge, the stoichiometric excess of the aluminum reductant component can be maintained. In the process of the present invention, the presence of the silicon alloy in the reduction furnace has the further advantage of reducing the amount of aluminum vapors evolved from the reactant mass, allowing the production of a relatively pure magnesium product as compared to the magnesium product produced by the process of U.S. Pat. No. 3,782,922. However, this is accomplished without sacrificing the highly desirable reactivity qualities of an aluminum reducing agent. Similar to the auxilliary metal of the modified aluminothermic process of British Pat. No. 922,300, the silicon component of the alloy reductant passes through the system with minimal or no "losses" to the molten slag in the form of silica. The process of the present invention is thus a desirable alternative to and improvement over known metallothermic processes for the production of magnesium using highly effective aluminum in the form of relatively inexpensive aluminum silicon alloy as reductant.

DETAILED DESCRIPTION OF THE INVENTION

Figure 1:
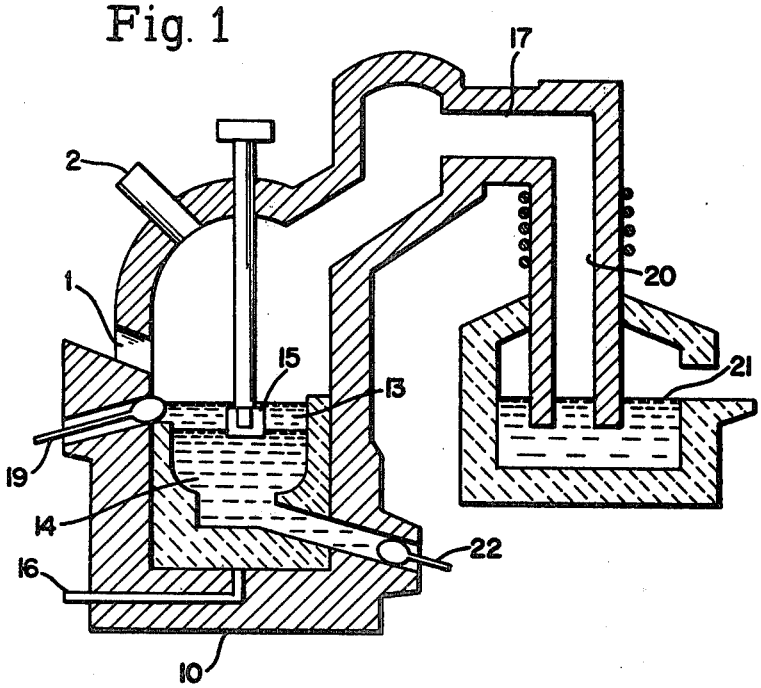
FIG. 1 shows an apparatus suitable for carrying out the process of this invention.

The aluminum silicon alloy reductant of the present invention may have a Si:Al ratio between about 0.4:1 to 4:1. However, since the spent alloy reductant withdrawn from the reduction furnace has a Si:Al ratio between about 2:1 to 6:1, the Si:Al ratio of the alloy charged to the reduction furnace is desirably within the range from about 0.4:1 to 2:1. In a preferred embodiment of the process of this invention, the Si:Al ratio of the alloy reductant charged to the reduction furnace is about 0.7:1 and the Si:Al ratio of the spent alloy reductant withdrawn from the reduction furnace is about 4:1. Various processes are known which produce aluminum-silicon alloys having the foregoing composition. For example, starting from kaolin (or quartzite) and alumina it is well known that alloys containing 60 or even 70 percent aluminum may be produced in an arc furnace. In particular, the processes disclosed and claimed in U.S. Pat. Nos. 3,254,988 and 3,665,362 produce alloys suitable for use as the reductant of the invention.

The magnesium oxide reactant comprises dolime ($CaO.XMgO$, where $0.5 \leqq X \leqq 2.0$) or other materials or mixtures of minerals consisting of magnesium oxide and calcium oxide having a molar ratio of MgO:CaO less than about 4:1. Magnesia may be used to supply MgO and lime may be used to supply CaO. Preferably, the oxide charge contains principally (about 50 weight percent or more) dolomite. The presence of impurities such as titania should not exceed about 5 weight percent. In other words, the oxide charge to the process of this invention comprises magnesium oxide and calcium oxide in a molar ratio from about 1.0:1 to 4.0:1. Preferably, the oxide charge comprises magnesium oxide and calcium oxide in a molar ratio of from about 1.3:1 to 2.1:1.

The amount of magnesium oxide charged is less than the stoichiometric amount theoretically required to consume the aluminum component of the alloy reductant. The amount of magnesium oxide in the oxidant charge is between about 80 to 98 and preferably, 88 to 92 percent by weight of the stoichiometric amount.

An important consideration in the operation of the reduction furnace is that the material in the furnace be molten so that it can be tapped. The furnace temperature should be high enough to form a molten slag, but higher temperatures are not preferred. The necessary slag temperature is known to depend on the ratio of $Al_2O_3$:CaO:MgO in the slag and particularly on the alumina and calcium oxide content of the slag. Preferably the alumina present in the slag of the process of this invention is derived totally from the reaction products of the reduction of the oxide charge to metallic magnesium. The slags generated by the process of this invention have liquidus temperatures in the range of 1500° C. to about 1900° C. The magnesium pressure produced will depend upon the thermodynamic activity of the aluminum in the aluminum silicon alloy which is periodically tapped, as a by-product, and upon the activity of magnesium oxide in the molten slag in contact with the by-product alloy layer in the furnace.

The activity of aluminum in the by-product alloy layer in the furnace is determined principally by the percent aluminum in the alloy, which is controlled by increasing or decreasing the heat release in the furnace.

The activity of magnesium in the slag is determined by the temperature of the slag and its composition, which in turn is controlled by the weight ratio of MgO to CaO and the weight ratio of MgO to aluminum in the furnace feed.

Figure 2:
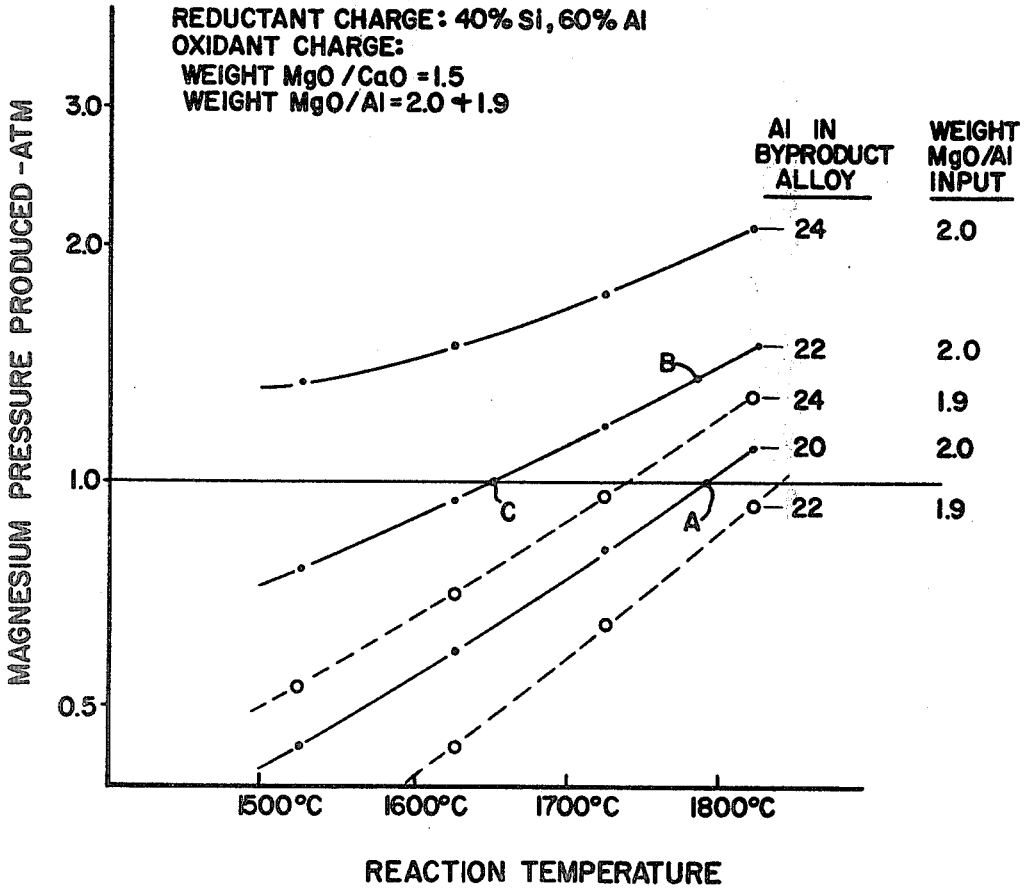
FIG. 2 shows the relationship of pressure to reaction temperature in the furnace as a function of the percent aluminum in the by-product alloy for typical charge compositions.

FIG. 2 may be used to illustrate the inherent stability of the system with respect to the control of percent aluminum in the by-product alloy. Consider, for example, that a steady state has existed corresponding to point A, where the furnace charge is 40% Si:60% Al by weight, the reductant charge is 1.5 parts by weight MgO to 1 part CaO, the weight ratio of MgO to aluminum in the charge is 2:1, the by-product alloy contains 20% aluminum and the temperature is 1790°C. If for some reason there should occur a temporary diminution of the rate of magnesium production, then the aluminum concentration in the by-product alloy would tend to increase; for example, to point B. The activity of the aluminum would therefore increase, the equilibrium pressure of magnesium would tend to increase and the reaction to produce magnesium would proceed faster, tending to counteract the effects of the disturbance.

If the furnace has been operating steadily at a point of A of FIG. 2, and it is desired to increase the percentage of aluminum on the by-product alloy, one of two control actions can be taken: (a) the heat input to the furnace can be decreased to achieve a reaction temperature of, say, 1650°C., corresponding to point C, or (b) the weight ratio of MgO to aluminum in the furnace charge can be decreased.

The relationships of these operating parameters are further described in the Examples, infra.

Quantitatively, the slag composition of the process of the present invention may be expressed as $MgO.CaO.Al_2O_3.TiO_2$. The titania content is an impurity of the aluminum-silicon alloy and will be present in the alloy in amounts less than about 3 weight percent. Silica may also be present in the slag but in amounts less than about 5 weight percent. Quantitatively, the slag composition may be expressed as follows:

| | | Percent (Wt.) | |
|---|---|---|---|
| Component | Broad Range | Preferred Range | Highly Preferred Range |
| $Al_2O_3$ | 41–63 | 41–58 | 49–52 |
| CaO | 27–54 | 40–54 | 43–44 |
| MgO | <10 | <7 | <5 |
| $SiO_2$ | 0–5 | 0–5 | 0–5 |

The molten slags of the process of this invention having a composition within the more preferred ranges of the preferred ranges shown in the foregoing table may be preferred to as basic slags. Basic slags have a calcium oxide content of at least 40 percent and usually about 50 percent. Such slags are characterized by a relatively sharp melting point and form a fluid slag of low viscosity with little superheat. To be contrasted with basic slags are acidic slags which have a somewhat vague melting point and form rather viscous, "glassy" slags which require considerable superheat to achieve lower viscosity.

In the process of this invention the more fluid basic slags are desired because of mass transport considerations, and such more fluid slags occur at charge weight ratios of MgO/CaO below about 1.50 to 1, corresponding to molar ratios below about 2.0 to 1.

In the process of this invention the lower the ratio of MgO to CaO in the charge, the higher the unit consumption of oxidant raw materials, but the lower the ratio of magnesia to dolomite in the charge. Thus for practical and economic reasons, the preferred ratio of MgO to CaO is around 1.5 to 1, and the ratio of MgO to aluminum in the charge composite is around 2.0 to 1, corresponding to a by-product alloy having 22% aluminum, a slag containing about 44% CaO, 50% $Al_2O_3$and 6% MgO, and using a reductant feed of 40% silicon 60% aluminum.

In carrying out the invention, a slag of a composition within the foregoing ranges is prepared and melted in a magnesium production furnace. The various slag ingredients may be mixed together or a slag of a suitable composition from a previous operation may be used. Heat is supplied for melting either by striking an arc between electrodes suitably located inside the magnesium production furnace or, preferably, by suitably locating one or more carbon electrodes so as to pass a current through the slag (i.e., in a direct arc furnace) or by any other suitable means. After the desired temperature of the molten slag is achieved, aluminum silicon alloy is charged to float as a liquid layer upon the molten slag. At the same time an oxide feed having the above-described composition is added to the slag or, alternatively, the oxide feed is intermingled with the alloy and the mixture is charged to the furnace. The charge rates of alloy and oxide are adjusted so that less than the stoichiometric amount of magnesium oxide theoretically required to consume the aluminum component of the alloy charge is added to the system and so that the slag composition remains relatively constant. Magnesium vapor is evolved, conducted to a suitable condenser, and is condensed at a pressure of about one atmosphere. As the reaction proceeds, the levels of slag and spent alloy in the furnace rise. Periodically, portions of the slag layer and of the spent alloy layer are removed through suitable tap holes in the furnace wall.

Referring now to FIG. 1, which shows an apparatus suitable for carrying out the process of this invention, an example of a preferred embodiment of this process will be described. A molten aluminum silicon alloy from a standard electric arc furnace adapted to produce aluminum silicon alloy is introduced to magnesium production furnace 10 through line 1. The alloy contains about 60 weight percent aluminum and 40 weight percent silicon. Simultaneously with the introduction of alloy, dolomite containing calcium oxide and magnesium oxide in a molar ratio of about 1:1 is introduced through line 2. The molar ratio of MgO:Al charged in the oxidant and reductant respectively is about 1.4:1. The alloy charged to the furnace floats as a liquid layer 13 upon a slag layer 14 containing about 44 percent CaO, 50 percent $Al_2O_3$, and 6 percent MgO. Heat is applied in the furnace 10 by conducting electric current between electrodes 15 and 16 through the liquid slag to maintain the liquid at about 1700°C. and to cause the aluminum in the alloy layer 13 to react with MgO in the slag 14 to produce Mg(V). The reaction occurring in the furnace may be expressed as follows:

$$3\ MgO + 2\ Al \rightarrow 3\ Mg(V) + Al_2O_3$$

Heat transferred from the arc is sufficient to vaporize magnesium from the metal layer at about 1 atmosphere furnace pressure. Magnesium vapor evolved in the furnace 10 is removed through line 17 to condenser 20. The heat transfer rate in condenser 20 is adjusted to condense magnesium at a pressure of about 1 atmosphere and the condensed magnesium is cooled to about 850°C. before leaving the condenser discharge circuit through line 21. Approximately 90 percent of the magnesium charged as dolomite and magnesia is recovered as magnesium metal. The spent aluminum silicon alloy in layer 13 is at least periodically tapped through tap hole 19 to be used in production of a silicon alloy by addition to aluminum and the slag in layer 14 is tapped through line 22 at a rate to maintain slag level and is rejected from the metal producing system.

EXAMPLES I–III

The following table describes three examples of the process of this invention generally carried out in conformance to the foregoing description of FIG. 1.

| | I | II | III |
|---|---|---|---|
| Reductant Charge (lbs./hr.) | 100 | 100 | 100 |
| Al | 60 | 60 | 50 |
| Si | 40 | 40 | 50 |
| Oxidant Charge (lbs./hr.) | 240 | 200 | 166.6 |
| Dolomite | 206 | 80 | 114.5 |
| MgO | 34 | 92 | 52.1 |
| MgO/CaO weight ratio | 1.0 | 1.5 | 1.5 |
| MgO/Al weight ratio | 2.0 | 2.0 | 2.0 |
| Slag Discharge (lbs./hr.) | 222.5 | 183.0 | 152.5 |
| CaO | 120.0 | 80.0 | 66.7 |
| $Al_2O_3$ | 94.5 | 92.0 | 76.4 |
| MgO | 8.0 | 11.0 | 4.7 |
| By-product Alloy (lbs./hr.) | 50 | 51.2 | 59.5 |
| Al | 10 | 11.2 | 9.5 |
| Si | 40 | 40 | 50 |
| Magnesium Product (lbs.hr.) | 67.5 | 65.8 | 54.6 |
| Weight Oxidant charges/Mg Prod. | 3.56 | 3.04 | 3.05 |
| Weight Reductant Alloy/Mg Prod. | 1.48 | 1.51 | 1.68 |
| Stoichiometric ratio of MgO charged relative to the amount required to react with available Al. | 89.3% | 89.3% | 89.3% |
| Reduction Temperature (°C.) | 1740 | 1660 | 1740 |
| Mg Furnace Pressure (atm.) | 1.0 | 1.0 | 1.0 |
| Condensation Temperature (°C.) | 1000 | 1000 | 1000 |

The system pressure shown in the Examples is controlled by adjusting the cooling rate of the condenser to maintain the recited condensate temperature. Note that the temperatures shown do take into account the pressure drop caused by mass transport of Mg(V) from the reaction zone (i.e., the magnesium reduction furnace) to the condenser. The lower limit of condensate temperature is the melting point of magnesium or physical violence in the furnace, whichever occurs first.

The slags produced in Examples I, II and III are entirely liquid at the operating temperatures cited in the examples. The presence of aluminum in the by-product alloy assures that the amount of silicon reacting to produce magnesium is insignificant, and the silicon and calcium oxide components of the furnace feed pass on through to the slag discharge.

The process can be operated below 1.0 atm. (for example, 0.8 atm. or above) by application of control principles familiar to those normally skilled in the art in view of the principles that have been disclosed herein. However, it is preferred to operate at 1 atm. or more (for example, 1.5 atm.) to avoid leaking of air into the furnace.

In the Examples I, II and III, representing preferred embodiments of this invention, the amount of MgO contained in the feed is about 89% of the stoichiometric amount required to react completely with the aluminum provided by the reductant charge. The reason that the MgO is not entirely reacted is that the mass rate of aluminum withdrawn from the furnace with the by-product alloy is great enough to preclude complete reaction by the MgO, as dictated by steady state mass balance considerations. If the mass rate of aluminum withdrawn as a component of the by-product alloy were to be reduced to the rate allowing complete reaction of the MgO, the percentage and hence the activity of aluminum in the alloy would be so low that excessively high temperatures would be required to achieve the pressures near 1 atmosphere, which are preferred.

The conditions of Example II are superior to those of Example I, in that the operating temperature is lower, the consumption of raw materials is less, the by-product slag production is less and the by-product alloy has more aluminum in it. However, the conditions of Example II require a higher rate of magnesia and lower rate of dolomite which may affect the economics of the process in some locations.

The conditions of Example III illustrate the point that a feed alloy leaner in aluminum can be used without significant penalty in oxidant material costs, but will result in higher reductant consumption than shown for Examples I and II.

What is claimed is:

1. An improved metallothermic process for the manufacture of magnesium wherein an aluminum-silicon alloy reductant and an oxidant comprising an oxide mixture containing MgO and CaO are charged to the reaction zone of a reduction furnace in the presence of a molten calcium-aluminate slag and magnesium vapor is evolved from the reaction zone and recovered in a condensing means, the improvement which comprises charging less than the stoichiometric amount of magnesium oxide in the oxidant required to consume the aluminum component of the aluminum-silicon alloy reductant to form two liquid layers in the reaction zone, a lower layer comprising calcium-magnesium-aluminate slag and an upper layer comprising spent aluminum-silicon alloy reductant, and at least periodically tapping the spent aluminum-silicon alloy from the reaction zone as a by-product.

2. The process of claim 1 wherein the aluminum-silicon alloy charged to the reaction zone has a Si:Al weight ratio within the range from about 0.4:1 to 4:1.

3. The process of claim 1 wherein the aluminum-silicon alloy charged to the reaction zone has a Si:Al weight ratio within the range from about 0.4:1 to 2:1 and the spent aluminum-silicon alloy tapped from the reaction zone has a Si:Al ratio within the range from about 2:1 to 6:1.

4. The process of claim 1 wherein the aluminum-silicon alloy charged to the reaction zone has a Si:Al ratio of about 0.7:1 and the spent aluminum-silicon alloy tapped from the reaction zone has a Si:Al ratio of about 4:1.

5. The process of claim 4 wherein the reaction zone is maintained at a temperature of about 1700° C. and a pressure of about 1 atmosphere.

6. The process of claim 1 wherein the amount of magnesium oxide in the oxidant charge is between about 80 to 98 percent by weight of said stoichiometric amount.

7. A metallothermic process for the production of magnesium which comprises:

(a) charging an aluminum-silicon alloy having a Si:Al weight ratio within the range from about 0.4:1 to 2:1 and an oxidant comprising magnesium oxide and calcium oxide having a molar ratio of MgO:CaO within the range of from about 4.0:1 to 1.0:1 to the reaction zone of a reduction furnace maintained at a temperature within the range of from about 1500° to 1900° C. and a pressure of from about 1 to 2 atmospheres, the amount of magnesium oxide charged to the reaction zone being less than 100 percent of the amount theoretically required to consume the aluminum component of the alloy charged, and the alloy being charged to float as a liquid layer upon a molten slag which comprises, on a weight basis exclusive of other components, about 40 to 60 percent alumina, about 40 to 55 percent calcium oxide, less than 10 percent magnesium oxide, and about 0 to 7 percent silica;

(b) evolving magnesium vapor from the reaction zone;

(c) recovering the magnesium product in a condensing means; and (d) at least periodically tapping from the reaction zone an aluminum silicon alloy having a Si:Al weight ratio within the range from about 2:1 to 6:1 from the separate liquid alloy layer present in the reaction zone.

8. The process of claim 7 wherein the oxidant comprising magnesium oxide and calcium oxide contains principally dolomite.

9. The process of claim 7 wherein the alloy charged to the reaction zone has a Si:Al weight ratio of about 0.7:1; the molten slag present in the reaction zone comprises about 50 to 55 percent alumina, 42 to 45 percent calcium oxide, less than 7 percent magnesium oxide, and 0 to 5 percent silica; and the alloy tapped from the reaction zone has a Si:Al weight ratio of about 4:1.

10. The process of claim 9 wherein heat is supplied in the reduction furnace by conducting electric current through the slag to maintain the liquids within the temperature range of about 1500° to 1900° C.

11. The process of claim 7 wherein the amount of magnesium oxide charged to the reaction zone of said reduction furnace is 80 to 98 weight percent of the amount theoretically required to consume the aluminum component of the aluminum-silicon alloy charged to the reaction zone.

12. The process of claim 7 wherein the molar ratio of MgO:CaO in the oxidant charge is within the range from about 1.3:1 to 2.1:1.

13. The process of claim 12 wherein the amount of magnesium oxide charged to the reaction zone of said reduction furnace is about 88 to 92 weight percent of the amount theoretically required to consume the aluminum component of the aluminum-silicon alloy charged to the reaction zone.

14. The process of claim 13 wherein the temperature of the molten materials present in the reaction zone is maintained at about 1700°C.

15. The process of claim 13 wherein the pressure in the reaction zone is maintained at about 1 atmosphere.

* * * * *